US012760940B2

(12) United States Patent
Seitz et al.

(10) Patent No.: US 12,760,940 B2
(45) Date of Patent: Oct. 13, 2026

(54) DUAL HELIUM COMPRESSORS

(71) Applicant: Sumitomo (SHI) Cryogenics of America, Inc., Allentown, PA (US)

(72) Inventors: Eric Robert Seitz, Macungie, PA (US); Stephen Dunn, Bethlehem, PA (US); Ralph C. Longsworth, Mount Desert, ME (US)

(73) Assignee: SUMITOMO (SHI) CRYOGENIC OF AMERICA, INC., Allentown, PA (US)

( * ) Notice: Subject to any disclaimer, the term of this patent is extended or adjusted under 35 U.S.C. 154(b) by 6 days.

(21) Appl. No.: 17/481,099

(22) Filed: Sep. 21, 2021

(65) Prior Publication Data

US 2022/0003462 A1 Jan. 6, 2022

Related U.S. Application Data

(62) Division of application No. 14/974,824, filed on Dec. 18, 2015, now Pat. No. 11,149,992.

(51) Int. Cl.
*F25B 9/06* (2006.01)
*F25B 1/00* (2006.01)
(Continued)

(52) U.S. Cl.
CPC ..... *F25B 9/06* (2013.01); *F25B 1/00* (2013.01); *F25B 9/002* (2013.01); *F25B 9/14* (2013.01);
(Continued)

(58) Field of Classification Search
CPC .... F25B 1/00; F25B 9/002; F25B 9/06; F25B 9/145; F25B 2309/003; F25B 2309/001;
(Continued)

(56) References Cited

U.S. PATENT DOCUMENTS 2,906,101 A 9/1959 McMahon et al.
5,094,598 A 3/1992 Amata et al.
(Continued)

FOREIGN PATENT DOCUMENTS

CN 1358966 A 7/2002
CN 200982291 Y 11/2007
(Continued)

OTHER PUBLICATIONS

International Search Report and Written Opinion of the International Searching Authority dated Apr. 3, 2017 from the corresponding International Application No. PCT/US2016/067079.
(Continued)

*Primary Examiner* — Frantz F Jules
*Assistant Examiner* — Webeshet Mengesha
(74) *Attorney, Agent, or Firm* — Katten Muchin; ROSENMAN LLP

(57) ABSTRACT

This invention relates to oil lubricated helium compressor units for use in cryogenic refrigeration systems, operating on the Gifford McMahon (GM) or Brayton cycle. The objective of this invention is to provide redundancy by having a water cooled compressor manifolded to an air cooled compressor and sensors to detect faults so that an expander can be kept running if there is a failure in either the water or air supply.

7 Claims, 3 Drawing Sheets

(51) Int. Cl.
*F25B 9/00* (2006.01)
*F25B 9/14* (2006.01)

(52) U.S. Cl.
CPC ... *F25B 2339/047* (2013.01); *F25B 2400/075* (2013.01)

(58) Field of Classification Search
CPC ..... F25B 2309/1408; F25B 2339/047; F25B 2400/075; F25B 9/00; F25B 9/14
See application file for complete search history.

(56) References Cited

U.S. PATENT DOCUMENTS

| | | | | |
|---|---|---|---|---|
| 6,453,691 | B1 * | 9/2002 | Seo | F25B 49/022 62/196.3 |
| 6,530,237 | B2 | 3/2003 | Morse et al. | |
| 7,674,099 | B2 * | 3/2010 | Dunn | F04C 23/008 418/55.6 |
| 8,187,370 | B2 | 5/2012 | Dunn et al. | |
| 8,978,400 | B2 | 3/2015 | Dunn et al. | |
| 2002/0139129 | A1 * | 10/2002 | Morse | F25B 45/00 62/149 |
| 2003/0010574 | A1 | 1/2003 | Longsworth | |
| 2005/0268641 | A1 | 12/2005 | Dekiya | |
| 2006/0122733 | A1 * | 6/2006 | Harrod | F24F 11/86 700/276 |
| 2008/0011550 | A1 | 1/2008 | Dunn et al. | |
| 2009/0126399 | A1 * | 5/2009 | Takegami | F25B 47/022 62/510 |
| 2010/0162742 | A1 * | 7/2010 | Shimoda | F04B 39/06 700/278 |
| 2010/0186433 | A1 * | 7/2010 | Galante | F04C 18/0215 62/115 |
| 2011/0107790 | A1 | 5/2011 | Dunn et al. | |
| 2012/0067065 | A1 * | 3/2012 | Ando | F04B 49/065 62/55.5 |
| 2013/0145781 | A1 | 6/2013 | Liu | |
| 2013/0160468 | A1 | 6/2013 | Kimura | |
| 2014/0130527 | A1 * | 5/2014 | Dumas | F25J 1/0276 62/115 |
| 2014/0157820 | A1 | 6/2014 | Okada | |
| 2015/0330651 | A1 * | 11/2015 | Goel | F25B 49/005 62/228.1 |

FOREIGN PATENT DOCUMENTS

| | | | |
|---|---|---|---|
| CN | 101105356 | A | 1/2008 |
| CN | 102052282 | A | 5/2011 |
| CN | 103635763 | A | 3/2014 |
| DE | 10-2011-076858 | A1 | 12/2012 |
| JP | 56-092055 | U1 | 7/1981 |
| JP | 59-077265 | A | 5/1984 |
| JP | 61-235648 | A | 10/1986 |
| JP | 2-248674 | A | 10/1990 |
| JP | 6-7024 | B2 | 1/1994 |
| JP | 2002-174463 | A | 6/2002 |
| JP | 2002-257062 | A | 9/2002 |
| JP | 2007-285630 | A | 11/2007 |
| JP | 2007-298029 | A | 11/2007 |
| JP | 2011-099669 | A | 5/2011 |
| JP | 2012-515880 | A | 7/2012 |
| WO | 2010/085593 | A2 | 7/2010 |
| WO | 2012/163739 | A1 | 12/2012 |

OTHER PUBLICATIONS

Chinese Office Action dated Mar. 4, 2019 for the Corresponding Chinese Patent Application No. 201680074169.9.
Japanese Office Action dated Jul. 2, 2019 for the Corresponding Japanese Patent Application No. 2018-527727.
Korean Office Action dated Jul. 22, 2019 for the Corresponding Korean Patent Application No. 10-2018-7019124.
Extended European Search Report dated Jan. 28, 2020, for the Corresponding European Patent Application No. 16876740.8.
Japanese Office Action dated Feb. 18, 2020, for the Corresponding Japanese Patent Application No. 2018-527727.
U.S Office Action dated May 18, 2018, from related U.S. Appl. No. 14/974,824.
U.S Office Action dated Jan. 23, 2019, from related U.S. Appl. No. 14/974,824.
U.S Office Action dated May 16, 2019, from related U.S. Appl. No. 14/974,824.
U.S Office Action dated Dec. 2, 2019, from related U.S. Appl. No. 14/974,824.
U.S Office Action dated Jun. 26, 2020, from related U.S. Appl. No. 14/974,824.
U.S Office Action dated Dec. 28, 2020, from related U.S. Appl. No. 14/974,824.
U.S Notice of Allowance dated Jun. 25, 2021, from related U.S. Appl. No. 14/974,824.
European Office Action dated Feb. 16, 2022, for the Corresponding European Patent Application No. 16876740.8.
Communication under Rule 71(3) EPC dated Aug. 22, 2024, from European Patent Application No. 16876740.8, 21 sheets.

* cited by examiner

DUAL HELIUM COMPRESSORS

CROSS REFERENCE TO RELATED APPLICATIONS

This application is a divisional application of U.S. patent application Ser. No. 14/974,824 filed on Dec. 18, 2015, the entire content of which is incorporated herein by reference in its entirety.

BACKGROUND OF THE INVENTION

1. Field of the Invention

This invention relates generally to oil lubricated helium compressor units for use in cryogenic refrigeration systems operating on the Gifford McMahon (GM) and Brayton cycles. More particularly, the invention relates to dual compressors that provide redundancy between water cooling and air cooling if there is a failure in one or the other or if there is a system advantage in operating one or the other or both.

2. Description of the Related Art

The basic principal of operation of a GM cycle refrigerator is described in U.S. Pat. No. 2,906,101 to McMahon, et al. A GM cycle refrigerator consists of a compressor that supplies gas at a discharge pressure to an inlet valve which admits gas to an expansion space through a regenerator, expands the gas adiabatically within a cold end heat exchanger where it receives heat from an object being cooled, then returns the gas at low pressure to the compressor through the regenerator and an outlet valve. The GM cycle has become the dominant means of producing cryogenic temperatures in small commercial refrigerators primarily because it can utilize mass produced oil-lubricated air-conditioning compressors to build reliable, long life, refrigerators at minimal cost. GM cycle refrigerators operate well at pressures and power inputs within the design limits of air-conditioning compressors, even though helium is substituted for the design refrigerants. Typically, GM refrigerators operate at a high pressure of about 2 MPa, and a low pressure of about 0.8 MPa.

A system that operates on the Brayton cycle to produce refrigeration consists of a compressor that supplies gas at a discharge pressure to a heat exchanger, from which gas is admitted to an expansion space through an inlet valve, expands the gas adiabatically, exhausts the expanded gas (which is colder) through in outlet valve, circulates the cold gas through a load being cooled, then returns it to the compressor at a low pressure through the heat exchanger. Brayton cycle refrigerators operating at cryogenic temperatures can also be designed to operate with the same compressors that are used for GM cycle refrigerators.

The cold expander in a GM refrigerator is typically separated from the compressor by 5 m to 20 m long gas lines. The expanders and compressors are usually mounted indoors and the compressor is usually cooled by water, most frequently water that is circulated by a water chiller unit at a temperature that is typically in the midrange of 10° C. to 40° C. for which the compressor is designed. Air cooled compressors that are mounted indoors are typically cooled by air conditioned air where the temperature is in the range of 15° C. to 30° C.

Disadvantageously, compressors designed for air-conditioning service require additional cooling when compressing helium because monatomic gases including helium get a lot hotter when compressed than standard refrigerants. U.S. Pat. No. 7,674,099 describes a means of adapting a scroll compressor manufactured by Copeland Corp. by injecting oil along with helium into the scroll such that about 2% of the displacement is used to pump oil. Approximately 70% of the heat of compression leaves the compressor in the hot oil and the balance in the hot helium. The Copeland compressor is oriented horizontally and requires an external bulk oil separator to remove most of the oil from the helium.

Another scroll compressor that is widely used for compressing helium is manufactured by Hitachi Inc. The Hitachi compressor is oriented vertically and brings the helium and oil directly into the scroll through separate ports at the top of the compressor and discharges it inside the shell of the compressor. Most of the oil separates from the helium inside the shell and flows out of the shell near the bottom while the helium flows out near the top.

Helium compressor systems that use the Copeland and Hitachi scroll compressors have separate channels in one or more after-coolers for the helium and oil. Heat is transferred from the oil and helium to either air or water. The cooled oil is returned to the compressor and the cooled helium passes through a second oil separator and an adsorber before flowing to the expander. U.S. Pat. No. 7,674,099 shows after-cooler 8 as being a single heat exchanger cooled by water. This is a typical arrangement for helium compressor systems that operate indoors where chilled water is available. Air cooled compressors have been designed for operation either indoors or outdoors. FIGS. 3A and 3B in U.S. Pat. No. 8,978,400 shows an arrangement with a Hitachi scroll compressor that has two air cooled oil coolers, one indoors and one outdoors while all the other components are indoors with the helium always cooled by air. As explained in the '400 patent, keeping all of the components that have helium in them indoors in an air condition environment, where the temperature is in the range of 15 to 30° C., minimizes the contaminants that evolve from hot oil and increases the life of the final adsorber. Rejecting some or all of the heat outdoors in the summer reduces the load on an air conditioning system while rejecting heat to the indoor air in the winter reduces the load on the heating system. Two compressors, one air cooled operating either indoors or outdoors and the other water cooled operating indoors, can provide redundancy if one fails and can extend the time between services if each is operated for a significant part of the year. Air cooled oil lubricated helium compressors that are used outdoors are typically designed to operate in the temperature range of −30 to 45° C. The power input to these compressors is typically in the range of 2 to 15 kW.

SUMMARY OF THE INVENTION

The objective of this invention is to provide redundancy in the helium compressor system operating with a GM cycle expander to produce refrigeration at cryogenic temperatures. An important application is the cooling of superconducting MRI magnets which operate at temperatures near 4K and require very reliable operation. Most MRI systems are located in hospitals and have chilled water available, so the primary helium compressor is water cooled. In the event of a failure in the water cooling system or the water cooled compressor this invention provides a backup air cooled helium compressor connected to a common manifold in such a way that the cross-over from one compressor to the other does not affect the operation of the expander.

DESCRIPTION OF THE PREFERRED EMBODIMENTS

Figure 1:
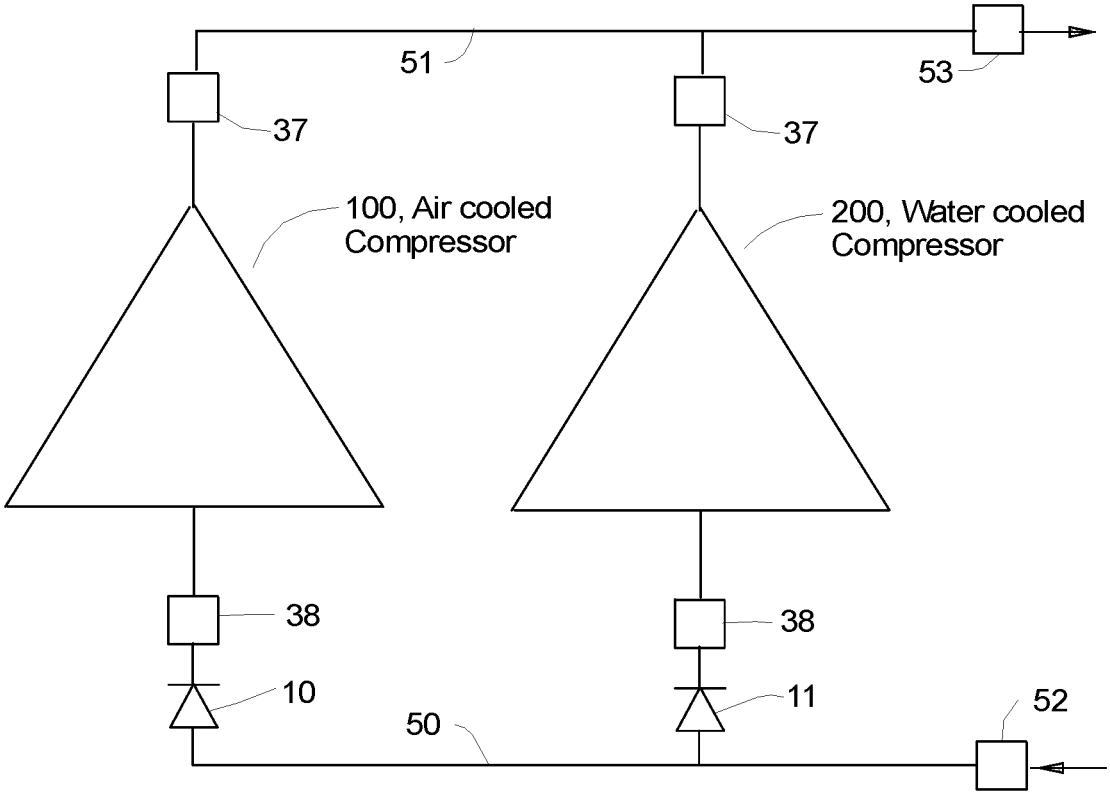
FIG. 1 is a schematic of the compressors shown in FIGS. 1 and 2 connected to supply and return manifolds.

Parts that are the same or similar in the drawings have the same numbers and descriptions which are not repeated. FIG. 1 is a schematic diagram showing how air cooled oil lubricated helium compressor 100 can be manifolded with water cooled oil lubricated helium compressor 200 to supply gas to a GM expander. Gas returning from the expander enters low pressure manifold 50 through coupling 52 and is split to flow to air cooled compressor 100 through check valve 10 or to water cooled compressor 200 through check valve 11. Both compressors are connected to high pressure manifold 51 and the GM expander through coupling 53. Check valves 10 and 11 prevent gas from flowing into the return gas manifold 50 when the compressors are turned off. Having both compressors connected directly to high pressure manifold 51 results in the compressor that is off being at high pressure and also prevents oil from migrating out of the compressor that is "off" to the one that is "on". When a GM refrigerator with a single oil lubricated compressor shuts down the equilibrium pressure will be closer to the high pressure than the low pressure because there is typically more volume at high pressure, e.g. in the oil separator and adsorber, than low pressure. When two compressors are connected in parallel and only one is running while the other has high pressure in it requires that the equilibrium pressure when they are both off be higher than when they are connected separately to an expander.

Figure 2:
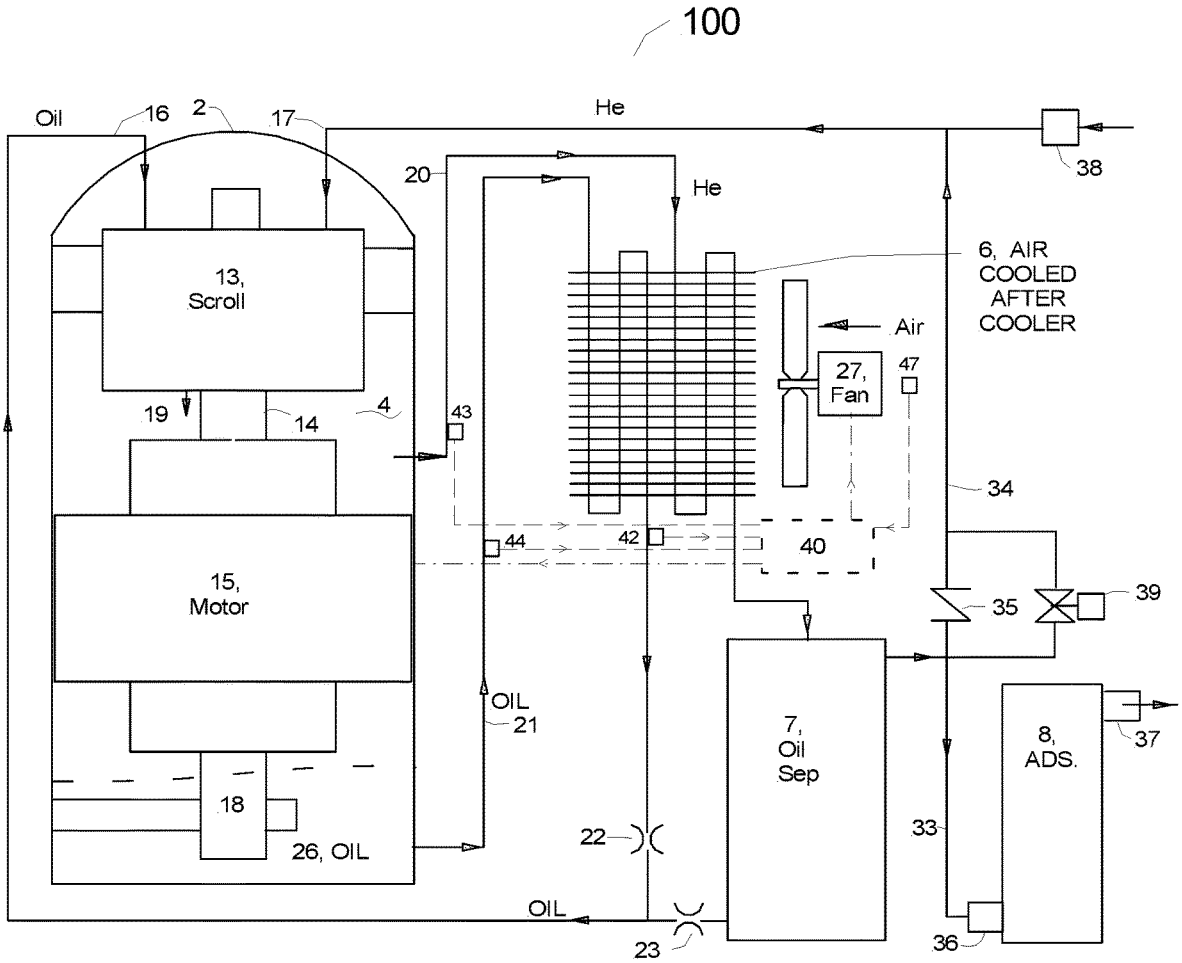
FIG. 2 is a schematic diagram of an oil-lubricated helium compressor system that has an air cooled after-cooler.
Figure 3:
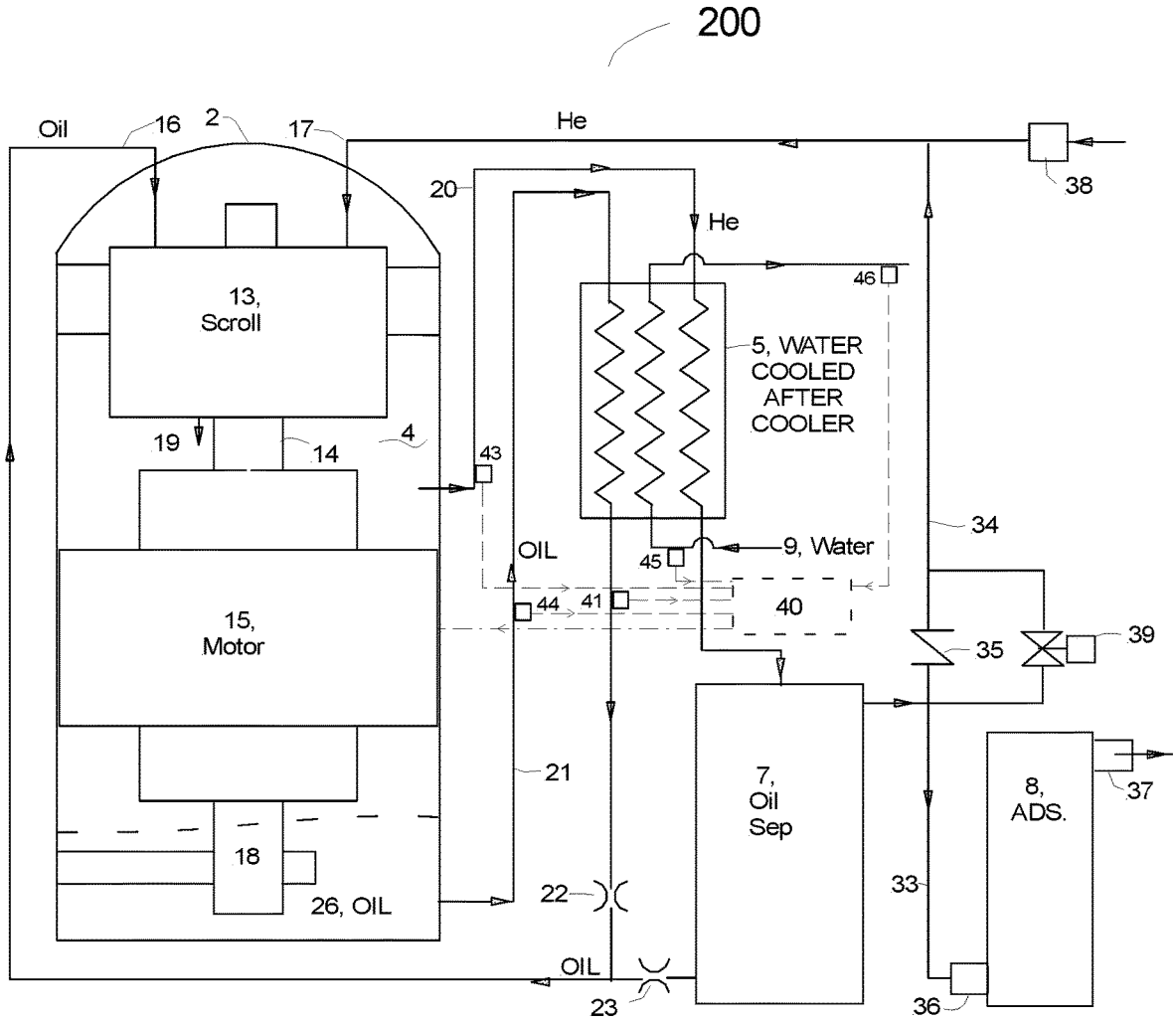
FIG. 3 is a schematic diagram of an oil-lubricated helium compressor system that has a water cooled after-cooler.

FIG. 2 is a schematic diagram of oil-lubricated helium compressor system 100 which has an air cooled after-cooler and FIG. 3 is a schematic diagram of oil-lubricated helium compressor system 200 which has a water cooled after-cooler. The standard compressor systems that are presently being manufactured by the assignee of this invention are essentially the same as shown in these figures. These figures show the vertical Hitachi scroll compressors but the schematics for the horizontal Copeland compressors are similar.

Compressor system components that are common to both of the figures are: compressor shell 2, high pressure volume 4 in the shell, compressor scroll 13, drive shaft 14, motor 15, oil pump 18, oil in the bottom of the compressor 26, oil return line 16, helium return line 17, helium/oil mixture discharge from the scroll 19, oil separator 7, adsorber 8, main oil flow control orifice 22, orifice 23 which controls the flow rate of oil from the oil separator, gas line 33 from oil separator 7 to adsorber 8 internal relief valve 35 and pressure equalization solenoid valve 39, gas line 34 from internal relief valve 35 and pressure equalization solenoid valve 39 to helium return line 17, adsorber inlet gas coupling 36, adsorber outlet gas coupling 37 which supplies high pressure helium to the expander, and coupling 38 which receives low pressure helium from the expander.

Air cooled compressor system 100 in FIG. 2 shows high pressure helium flowing from compressor 2 through line 20 which extends through air cooled after-cooler 6 to oil separator 7. High pressure oil flows from compressor 2 through line 21 which extends through air cooled after-cooler 6 to main oil control orifice 22. Fan 27 drives air through after-cooler 6 in a counter-flow heat transfer relation with the helium and oil.

Water cooled compressor system 200 in FIG. 3 shows high pressure helium flowing from compressor 2 through line 20 which extends through water cooled after-cooler 5 to oil separator 7. High pressure oil flows from compressor 2 through line 21 which extends through water cooled after-cooler 5 to main oil control orifice 22. Cooling water 9 flows through after-cooler 6 in a counter-flow heat transfer relation with the helium and oil.

A primary concern in using oil lubricated compressors that are designed for air conditioning refrigerants is the management of oil. First a lot more oil is compressed along with the gas in order to cool the helium and secondly the cryogenic expanders cannot tolerate any oil thus requiring an extensive oil removal system. There is also a concern for oil migration during start up and shut down. Pressure equalization solenoid valve 39 opens when the compressor turns off in order to avoid having high pressure gas in compressor 2 blow oil back through return line 17 where it can migrate to the expander.

The preference for having the water cooled after-cooler as the primary cooler is typical but there may be circumstances when the air cooled after-cooler is the primary cooler and the water cooled after-cooler is used as a backup. Some MRI magnets are kept cold during transport by running the refrigerator using the air cooled compressor because electrical power is available but not cooling water. It is also possible that the air cooled after-cooler is used in the winter to help heat the building and the water cooled after-cooler is used in the summer to minimize the load on the air conditioner.

The most likely causes of failures in a water cooled after-cooler are fouling of the heat exchanger, low cooling water flow rate, and high inlet water temperature. For an air cooled after-cooler the most likely causes are blockage of the air flow, failure of the fan, and high air temperature. Temperature and pressure sensors are used to monitor the operation of the refrigeration system. Temperature sensors that are critical to detect a failure are located on one or more of the following lines: line 41—oil out of water cooled after-cooler 5, line 42—oil out of air cooled after-cooler 6, line 43—helium discharge temperature in line 20, line 44—oil temperature leaving the compressor in line 21, lines 45 and 46—water line 9 in and out of water cooled after-cooler 5, and indoor and outdoor air temperatures. Other fault sensors such as a cooling water flow rate sensor might be used.

The system that is being cooled, such as an MRI magnet, generally has the control system 40 that determines which of the two compressors is running. The designer of the control system determines which sensors in each of the compressors provide critical signals that can be used to determine when to switch from one compressor to the other. Switching can be done with the operating compressor turned off before the other is turned on, but it is preferable for the one that is off to be turned on before the other is turned off. Having both compressors on at the same time results in gas by-passing through internal relief valves 35. The control system keeps the expander operating if at least one compressor is turned on.

While this invention has been described in most detail for GM cycle refrigerators cooling MRI magnets at 4K it is also applicable to Brayton cycle refrigerators and applications such as cooling cryopumping panels at 150K. It will also be understood that it is capable of further modification, uses and/or adaptations, following in general the principal of the invention, and including such departures from the present disclosure as come within known or customary practice in the art to which the invention pertains, and as may be applied to the essential features herein before set forth, as fall within the scope of the invention or the limits of the appended claims. Also, it is to be understood that the phraseology and terminology employed herein, as well as the abstract, are for the purpose of description and should not be regarded as limiting.

It is also understood that the following claims are intended to cover all of the generic and specific features of the invention described herein.

What is claimed is:

1. A method to maintain operation of a Gifford McMahon (GM) refrigerator system operating at cryogenic temperatures during a disruption of cooling by using a compressor system supplying gas to an expander and being cooled with either water or air, said compressor system comprising:

an air cooled compressor having a first supply side and a first return side, wherein the air cooled compressor contains oil and further includes a pressure equalization valve that equalizes pressures within the air cooled compressor to prevent migration of the oil to the expander, and the pressure equalization valve opens to avoid having high pressure gas in the air cooled compressor blow the oil in the air cooled compressor back through the first return side when the air cooled compressor turns off, a water cooled compressor having a second supply side and a second return side, wherein the water cooled compressor contains oil and further includes a pressure equalization valve that equalizes pressures within the water cooled compressor to prevent migration of the oil to the expander, and the pressure equalization valve opens to avoid having high pressure gas in the water cooled compressor blow the oil in the water cooled compressor back through the second return side when the water cooled compressor turns off, and wherein the oil contained in the water cooled compressor is kept separate from the oil contained in the air cooled compressor, a gas supply manifold connected to the respective supply side of each compressor and a high pressure side of the expander, a gas return manifold connected to the respective return side of each compressor and a low pressure side of the expander, wherein the gas return manifold is configured to prevent gas from flowing from the air cooled and water cooled compressors toward the gas return manifold, a plurality of check valves formed on the gas return manifold to prevent the gas from flowing from either compressor into the gas return manifold, a plurality of sensors to detect critical operating parameters connected to a controller, the controller operating the expander at rated capacity with either one of the compressors on and the other off and during the period when one compressor is being turned on and other compressor is being turned off, the method comprising:

operating one of the air cooled and water cooled compressors for the operation of the GM refrigerator system;

determining, via the controller, whether the operation of the operating compressor has failed based on outputs from the sensors located inside the operating compressor; and turning, via the controller, the operating compressor off before or after turning the other compressor on, when the operation of the operating compressor has failed.

2. The method of claim 1 wherein said turning the operating compressor off before or after turning the other compressor on comprises turning the operating compressor off before turning the other compressor on.

3. The method of claim 1 wherein said turning the operating compressor off before or after turning the other compressor on comprises turning the other compressor on before turning the operating compressor off.

4. The method of claim 1 wherein said determining whether the operation of the operating compressor has failed comprises:

receiving signals from the plurality of sensors; and determining sensors among the plurality of sensors, which provide signals that are used to determine when to switch from the operating compressor to the other compressor.

5. The method of claim 1 wherein the plurality of sensors include temperature sensors configured to detect temperatures.

6. The method of claim 1 further comprising keeping the expander operating if at least one of the air cooled and water cooled compressors is turned on.

7. A method to conserve energy in maintaining an interior of a building at a temperature in a range of 15 to 30° C. and providing redundancy in a Gifford McMahon (GM) refrigerator system that is operating at cryogenic temperatures by using a compressor system supplying gas to an expander, said compressor system comprising:

an air cooled compressor having a first supply side and a first return side, wherein the air cooled compressor contains oil and further includes a pressure equalization valve that equalizes pressures within the air cooled compressor to prevent migration of the oil to the expander, and the pressure equalization valve opens to avoid having high pressure gas in the air cooled compressor blow the oil in the air cooled compressor back through the first return side when the air cooled compressor turns off, a water cooled compressor having a second supply side and a second return side, wherein the water cooled compressor contains oil and further includes a pressure equalization valve that equalizes pressures within the water cooled compressor to prevent migration of the oil to the expander, and the pressure equalization valve opens to avoid having high pressure gas in the water cooled compressor blow the oil in the water cooled compressor back through the second return side when the water cooled compressor turns off, and wherein the oil contained in the water cooled compressor is kept separate from the oil contained in the air cooled compressor, a gas supply manifold connected to the respective supply side of each compressor and a high pressure side of the expander, a gas return manifold connected to the respective return side of each compressor and a low pressure side of the expander, wherein the gas return manifold is configured to prevent gas from flowing from the air cooled and water cooled compressors toward the gas return manifold, a plurality of check valves formed on the gas return manifold to prevent the gas from flowing from either compressor into the gas return manifold, and a plurality of sensors to detect critical operating parameters connected to a controller, the controller operating the expander at rated capacity with either one of the compressors on and the other off and during the period when one compressor is being turned on and other compressor is being turned off, the method comprising:

locating both of the air cooled and water cooled compressors inside the building for operation of the GM refrigerator system;

comparing temperature outside the building and temperature inside the building; and operating one of the air cooled and water cooled compressors, to operate the GM refrigerator system, based on the comparison between the temperature outside the building and the temperature inside the building, comprising:

operating the water cooled compressor and operating the GM refrigerator system with the water cooled compressor, when the temperature outside the building is greater than the temperature inside the building;

operating the air cooled compressor and operating the GM refrigerator system with the air cooled compressor, when the temperature outside the building is less than the temperature inside the building; and switching to the nonoperating compressor in response to a failure of the operating compressor.

* * * * *